United States Patent [19]

Rossi et al.

[11] 4,214,136

[45] Jul. 22, 1980

[54] ELECTRICAL SWITCHES FOR CONTROL DEVICES SUCH AS TEMPERATURE REGULATORS

[75] Inventors: Guglielmo Rossi, Linkenheim; Hans Bösing, Oftersheim, both of Fed. Rep. of Germany

[73] Assignee: Ranco Incorporated, Columbus, Ohio

[21] Appl. No.: 13,194

[22] Filed: Feb. 16, 1979

[30] Foreign Application Priority Data

Feb. 24, 1978 [DE] Fed. Rep. of Germany ..... 2807943

[51] Int. Cl.[2] ..... H01H 5/26

[52] U.S. Cl. ..... 200/67 DA; 200/251; 200/283; 200/286

[58] Field of Search ..... 200/670, 67 D, 67 A, 200/250, 251, 283, 286

[56] References Cited

U.S. PATENT DOCUMENTS

| | | | |
|---|---|---|---|
| 2,286,053 | 6/1942 | Bletz | 200/67 DA X |
| 2,370,479 | 2/1945 | Meyer | 200/67 D |
| 2,374,986 | 5/1945 | Fetter | 200/67 D |
| 2,816,195 | 12/1957 | Holmes | 200/67 D X |
| 4,109,121 | 8/1978 | Bauer et al. | 200/67 DA X |
| 4,118,610 | 10/1978 | Purssell et al. | 200/67 DA |

*Primary Examiner*—Stephen Marcus

*Attorney, Agent, or Firm*—Watts, Hoffmann, Fisher & Heinke Co.

[57] ABSTRACT

An electrical snap action switch for use in a temperature regulator has a movable contact assembly consisting of a conductive contact carrying arm movable between fixed stops and cantilevered within the switch housing, the contact arm being parallel to and cooperating with a Q-shaped snap-action spring, so that the arm carries the working current while the snap spring acts on the arm to make the switch monostable in operation between the stops.

15 Claims, 2 Drawing Figures

ELECTRICAL SWITCHES FOR CONTROL DEVICES SUCH AS TEMPERATURE REGULATORS

BACKGROUND OF THE INVENTION

This invention relates to electrical switches for control devices, particularly for temperature regulators.

The purpose of a temperature regulator in a heating appliance is to switch off the appliance when a predetermined temperature has been reached and to switch the appliance on again whenever the temperature of the appliance falls below a certain pre-determined temperature. There is, however, a demand for small heavy duty switches for use with temperature regulators of small size. Heating appliances usually have a high current rating, which imposes a considerable strain on the switch contacts of the associated temperature regulator. If the separation of the switch contacts upon opening of a switch is observed in slow motion erosion by arcing becomes apparent. It follows, therefore, that the switch contacts should be separated as rapidly as possible, which in turn necessitates the use of a strong spring for moving the contacts apart. The material of the spring would not in general be sufficiently conductive to enable the switch to pass strong currents.

SUMMARY OF THE INVENTION

The present invention provides a new and improved snap acting electrical switch which is durable and has a long working life (that is, is capable of a large number of switching cycles) despite a relatively high contact current rating and a relatively small overall size and length of contact travel.

An electrical snap switch unit embodying the invention comprises at least one substantially stationary switch contact, a movable switch contact, a contact supporting member carrying the movable contact for motion into and away from engagement with the stationary contact, a stressed blade spring member extending toward the contacts having a portion effective to snap move in a direction transverse to the direction of extent of the blade spring and structure for interconnecting the blade spring portion and the contact supporting member so that snap movement of the blade member portion abruptly moves the contact supporting member to open or close the contacts.

In accordance with one preferred embodiment of the invention an electrical switch unit is provided for use in a control device such as a temperature regulator. The switch unit includes a housing having two stops at least one of which is a switch contact and a movable switch contact assembly movable between the stops and normally abutting one of them. The contact assembly includes a contact carrying member constructed of a material having a relatively great electrical conductivity and a snap action stressed blade spring member engaged with the contact supporting member for snap moving the contact supporting member into and away from a position in which the contacts are engaged.

The spring member is Q-shaped with two legs drawn toward each other to stress the blade and having lugs projecting into engagement with the contact supporting member to transmit snap motion to the contact supporting member.

The blade spring and contact supporting members are cantilevered in the housing and disposed substantially parallel to each other.

DETAILED DESCRIPTION OF THE DRAWINGS

Figure 1:
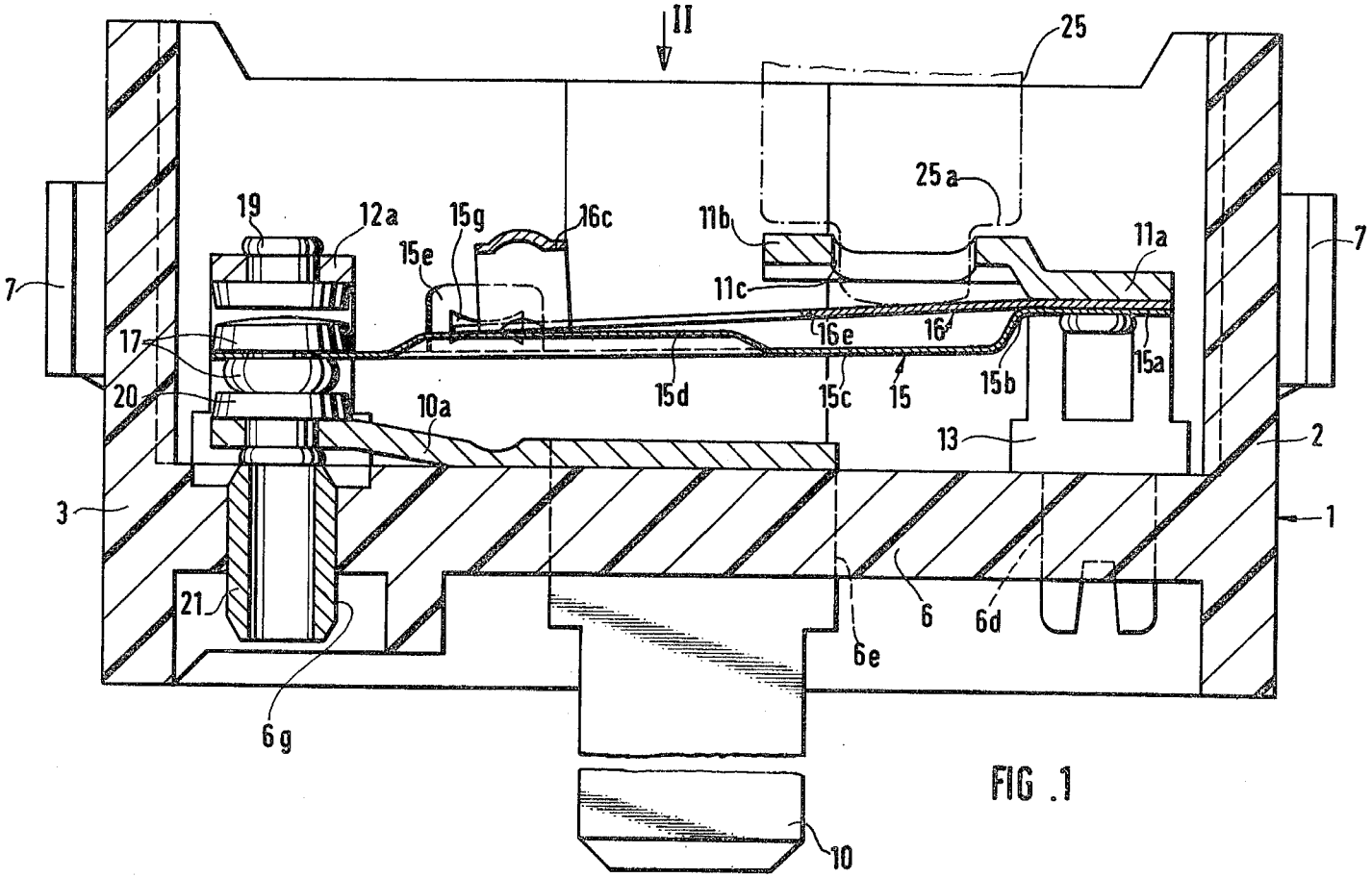
Figure 2:
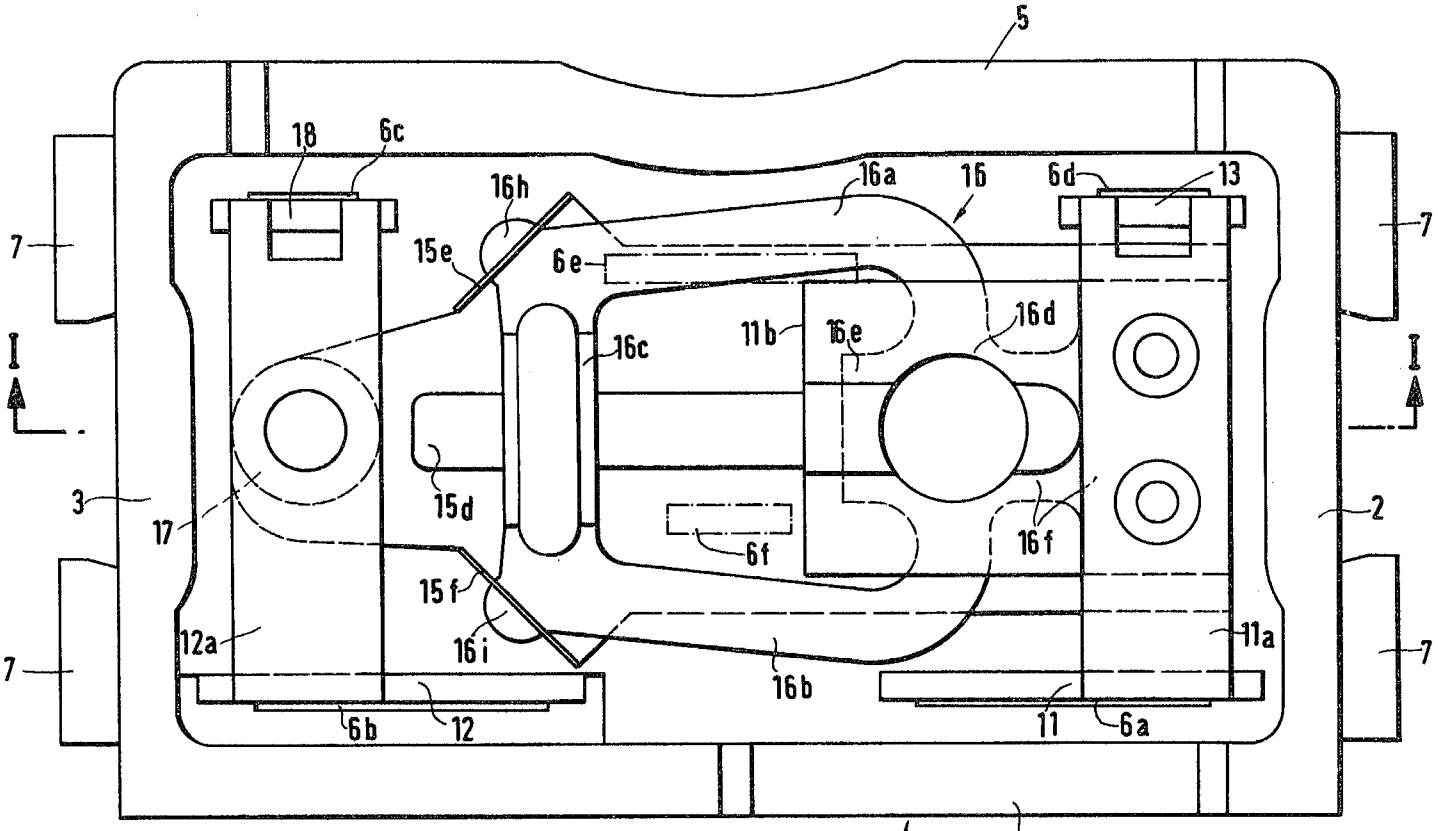

The invention will be further described, by way of example, with reference to the accompanying drawings, in which:

FIG. 1 is a longitudinal cross section of a switch according to one embodiment of the invention, taken along line I—I in FIG. 2, and FIG. 2 is a plan view of the switch in the direction of the arrow II in FIG. 1.

DETAILED DESCRIPTION OF THE INVENTION

The illustrated switch has a housing 1 made of an insulating material and having the appearance of an open box of rectangular shape typically measuring 33 (37)×21 mm and a depth of 18.5 mm, with two short sides 2,3 two long sides 4, 5 and a base 6. The side walls 2, 3, 5 project below the base 6, forming thereby a peripheral flange. The two shorter sides 2, 3 are provided with external projections 7 which cooperate with fixing stakes on the casing of a temperature regulator (not shown) to anchor the housing 1 to the regulator in a manner known per se.

The base 6 is provided near its four corners with respective rectangular slots **6*a*, 6*b*, 6*c* and 6*d* in which respective lugs are inserted and anchored. The base 6 is also provided with two further slots 6*e* and 6*f* near its centre. Respective flat terminal lugs 10, 11 and 12 are inserted and anchored in the slots 6*e*, 6*a* and 6*b* respectively. The terminal lug 11 is formed with an integral bridge portion 11*a* within the housing 1, extending parallel to the base 6 and supported by a cleat 13 which is anchored in the slot 6*d*. The bridge portion 11*a* has a laterally cantilevered support plate 11*b* with a central through hole 11*c*. A cantilevered switch contact-carrying arm 15 is riveted to the bridge portion 11*a* together with one end of a snap action spring 16**.

The snap action spring 16 is Q-shaped, having two lateral legs **16*a*, 16*b* interconnected at one end by a base portion 16*d* and at the other end by a connecting portion 16*c*. A trip tongue 16*e* projects from the base portion 16*d* towards the connecting portion 16*c*, and a mounting foot 16*f* projects from the base portion 16*d* in the opposite direction to the tongue 16*e*. The legs 16*a*, 16*b*, the base portion 16*d*, the connecting portion 16*c*, the tongue 16*e* and the foot 16*f*** are formed integrally with each other from a single piece of sheet metal—spring strip was originally used, but stainless steel strip is now preferred.

The two legs **16*a*, 16*b* are originally parallel to each other; the connecting portion 16*c* is then deformed by the formation of a double-curvature arch therein to draw the two legs 16*a*, 16*b* towards each other, thereby stressing the base portion 16*d*. This stressing results in a dish deformation of the snap action spring 16, whereby the connecting portion 16*d* is resiliently urged upwards or downwards. The direction of the dish deformation of the base portion 16*d* is determined by the trip tongue 16*e*: when the tongue 16*e* (FIG. 1) is moved downwards, the base portion 16*d* is dished in such a manner that the legs 16*a*, 16*b* are urged upwards as viewed in FIG. 1. The snap action spring 16 can therefore assume two stable positions according to the relative position of the trip tongue 16***e*.

The contact carrying arm 15 of the switch has essentially an isosceles triangular shape with a rounded vertex (FIG. 2) which a movable contact 17 is fastened. Adjacent its fixed end 15*a* the cantilevered arm 15 is formed with an angled step 15*b* connecting the fixed end to a flat portion 15*c* which imparts a resilient flexibility to the arm 15. The arm 15 is reinforced by means of a longitudinally extending stiffening corrugation 15*d*. The arm 15 is manufactured from copper plate and is substantially planar with the exception of two upstanding tabs 15*e*, 15*f* which are perpendicular to the general plane of the arm 15. The tabs 15*e*, 15*f* are inclined at an angle to each other, converging towards the contact 17. Each tab 15*e*, 15*f* is provided with a slot 15*g* which is diabolo shaped, with greater width at the ends than in the centre. Respective rounded lugs 16*h*, 16*i* at the ends of the legs 16*a*, 16*b* of the snap action spring 16 engage in the slots 15*g* so that the snap action spring 16 and the contact-carrying arm 15 are coupled to one another, constituting a movable switch contact assembly. The position of the switch contact 17 is determined by the snap action spring 16 the position of which is in turn determined by the trip tongue 16*e*. The switch contact assembly is effectively bistable but is prevented from occupying its end positions by engagement with restraining stops.

The terminal lug 12 is formed with an integral bridge-like contact-carrying portion 12*a* which extends transversely within the housing 1 parallel to the base 6, terminating in a bifurcated end in the vicinity of the slot 6*c*. This bifurcated end is supported by a cleat 18 inserted in the slot 6*c*, similar to the cleat 13 inserted in the slot 6*d*. In the centre of the bridge-like portion 12*a* a fixed contact 19 is fixed by rivetting, the contact 19 cooperating with the movable contact 17.

A further fixed contact 20 is fastened by rivetting to an arm 10*a* formed integrally with the terminal lug 10 and extending longitudinally within the housing 1 to a position opposite the movable contact 17. The two fixed contacts 19, 20 act effectively as stops limiting the angular movement of the movable contact assembly 15, 16 to an angular range which is less than half of the angular separation between the two stable positions of the bistable contact assembly 15, 16, that is, the angular movement which the said contact assembly 15, 16 would make if its movement were unobstructed. The position of the contacts 19, 20 is such that the contact assembly 15, 16 in moving between the fixed contacts 19, 20 does not pass through its overcentre or planar-symmetrical configuration, so that the contact assembly 15, 16 is always urged by the resilience of the snap action spring 16 in the same direction, in this example, towards the position shown in FIG. 1, in which the contact 17 engages the fixed contact 20. The switch therefore has a monostable action, even though the snap action spring 16 itself is a bistable element.

The base 6 has a hole 6*g* in which a tubular support 21 is inserted. The end of the tubular support 21 within the housing 1 supports the fixed contact 20. The distance of the projection of the support 21 into the interior of the housing 1 determines the position of the fixed contact 20 relative to the base 6 of the housing 1. As can be seen in FIG. 1, the contact 20 is accessible through the tubular support 21 for the purpose of, for example, triggering a switching cycle.

Instead of the tubular support 21, a screw-threaded socket may be screwed into the base 6 to support the fixed contact 20. The position of the fixed contact 20 would then be determined by screwing the socket into or out of the housing 1, deforming the arm 10*a* as shown in FIG. 1.

The electrical switch is operated by a plunger 25, shown in ghost outline in FIG. 1, forming part of the temperature regulator (not shown). When the temperature-sensing means of the temperature regulator senses a predetermined temperature, the plunger 25 is displaced downwards, as viewed in FIG. 1, to such a position that the trip tongue 16*e* is deflected sufficiently to trip the switch contact assembly 15, 16 upwards, away from the contact 20 and its engagement with the fixed contact 19. The circuit between the terminal lugs 10 and 11 is therefore interrupted, while a circuit is established between the terminal lugs 11 and 12.

The plunger 25 has a shoulder 25*a* which abuts the support plate 11*b* upon depression of the plunger to limit the stroke of the plunger 25. This avoids 'overtravel' of the switch, preventing excessive bending of the trip tongue 16*e* which could damage it.

According to the circuit in which the switch is connected, it can be employed as a normally-closed or normally-open switch, or as a selector switch. In any case the current passes predominantly through the contact carrying arm 15 which consists of a highly conductive material (copper or copper alloy), very little current in practice passing through the snap action spring 16, which may be made of a material of poor conducting properties such as stainless steel.

Although two elements 15, 16 form the movable contact assembly, they occupy in practice a space no bigger than that occupied by a single element, since both elements 15, 16 are substantially flat and lie substantially parallel to one another. This enables an electrical switch of very small overall size to have a high current rating.

We claim:

1. An electrical switch for use in a control device such as a temperature regulator, comprising:

a housing having two stops, at least one of which is a fixed switch contact; and, a movable switch contact assembly which is movable between the two stops and is normally in abutment with one of said stops;

the improvement comprising;

the movable switch contact assembly comprising a contact and contact carrying arm of electrically conductive material, and a Q-shaped snap action spring cooperating with said arm to snap move the arm for opening and closing the contacts said spring having two legs which are drawn toward each other to stress the spring and a trip tongue projecting from a portion of the spring interconnecting said legs, and said arm and said snap action spring being cantilevered within the housing and disposed substantially parallel to one another.

2. An electrical switch as defined in claim 1, wherein the contact carrying arm is copper-based and the snap action spring is of stainless steel.

3. An electrical switch as defined in claim 1 or 2, wherein the arm has openings and the snap action spring has projections which engage in said openings.

4. An electrical switch as defined in claim 3, wherein said arm is substantially flat, and has two upstanding tabs, each formed with the respective said openings in which the projections of the snap action spring engage.

5. An electrical switch as defined in claim 4, wherein the upstanding tabs are disposed in planes inclined to one another.

6. An electrical switch as defined in claim 1, wherein said arm has a reinforcing corrugation extending longitudinally thereof.

7. An electrical switch as defined in claim 1, wherein the stops are so disposed that the permitted range of angular movement of the movable contact assembly is less than half the total range of angular movement of the snap action spring between its stable positions.

8. An electrical switch as defined in claim 1, including means for adjusting the distance between the stops.

9. An electrical switch as defined in claim 1, further including operating means acting on said trip tongue for effecting movement of said spring and a support plate mounted within the housing for limiting the movement of said operating means.

10. An electrical snap switch unit comprising a base, at least one substantially stationary switch contact supported by said base, a movable switch contact, a contact supporting member carrying said movable contact for motion into and away from engagement with said substantially stationary contact, a stressed blade spring member anchored with respect to said base and extending toward said contacts from the anchor location, a portion of said spring member spaced from the anchor location effective to snap move in a direction transverse to the direction of extent of said blade spring member, structure for interconnecting said blade spring member portion and said contact supporting member so that snap movement of said blade spring member portion abruptly moves said contact supporting member to open or close said contacts.

11. The switch claimed in claim 10 wherein said structure for interconnecting said blade member and contact supporting member comprises at least one tab attached to one of said members, said tab defining an opening, and a lug attached to said other member and projecting into said opening.

12. The switch claimed in claim 11 wherein said blade member is formed of relatively stiffly resilient spring material and said contact supporting member is formed of flexible material having a relatively great electrical conductivity.

13. The switch claimed in claim 10 wherein said contact supporting member and said blade member coextend in confronting relationship with each other.

14. The switch claimed in claim 13 wherein said contact supporting member is anchored with respect to said base and extends cantilever fashion from its anchor location in the direction of said substantially stationary contact.

15. The switch claimed in claim 14 wherein said members are anchored to said base at a common location.

* * * * *